United States Patent [19]

Edmaier et al.

[11] 4,086,886

[45] May 2, 1978

[54] COOLING INSTALLATION

[75] Inventors: Franz Edmaier, Markdorf; Jürgen Wahnschaffe, Cologne, both of Germany

[73] Assignee: Motoren- und Turbinen-Union Friedrichshafen GmbH, Germany

[21] Appl. No.: 597,172

[22] Filed: Jul. 18, 1975

[30] Foreign Application Priority Data

Jul. 25, 1974 Germany ..... 2435839

[51] Int. Cl.[2] ..... F01P 7/04; F01P 7/10; F28F 13/12

[52] U.S. Cl. ..... 123/41.65; 123/41.49; 165/125

[58] Field of Search ..... 123/41.65, 41.66, 41.49; 165/125

[56] References Cited

U.S. PATENT DOCUMENTS

| | | | |
|---|---|---|---|
| 1,417,026 | 5/1922 | Caps | 165/125 |
| 1,884,898 | 10/1932 | Smith | 165/125 |
| 1,904,407 | 4/1933 | Cappa | 123/41.65 |
| 2,117,410 | 5/1938 | Erbach | 165/125 |
| 2,346,410 | 4/1944 | Ashley | 165/125 |
| 3,424,234 | 1/1969 | Laing | 165/125 |
| 3,800,866 | 4/1974 | Ireland | 165/125 |
| 3,921,603 | 11/1975 | Bentz | 123/41.49 |
| 3,978,919 | 9/1976 | Fachbach et al. | 165/125 |

*Primary Examiner*—Charles J. Myhre
*Assistant Examiner*—Parsholam Lall
*Attorney, Agent, or Firm*—Craig & Antonelli

[57] ABSTRACT

A cooling installation for liquid-cooled internal combustion engines, for example, for use in armored vehicles, in the form of an annular radiator block which is traversed by the cooling air from the inside toward the outside and which includes a radial blower equipped with a rotor axially sucking in the cooling air through an opening of the vehicle housing and arranged on the inside of the annular radiator; a base plate is thereby rigidly connected with the vehicle part supporting the cooling installation and is welded together with the annular radiator block into a self-supporting rigid unit while a bladeless annular space is provided between the radial-blower rotor and the annular radiator block.

18 Claims, 1 Drawing Figure

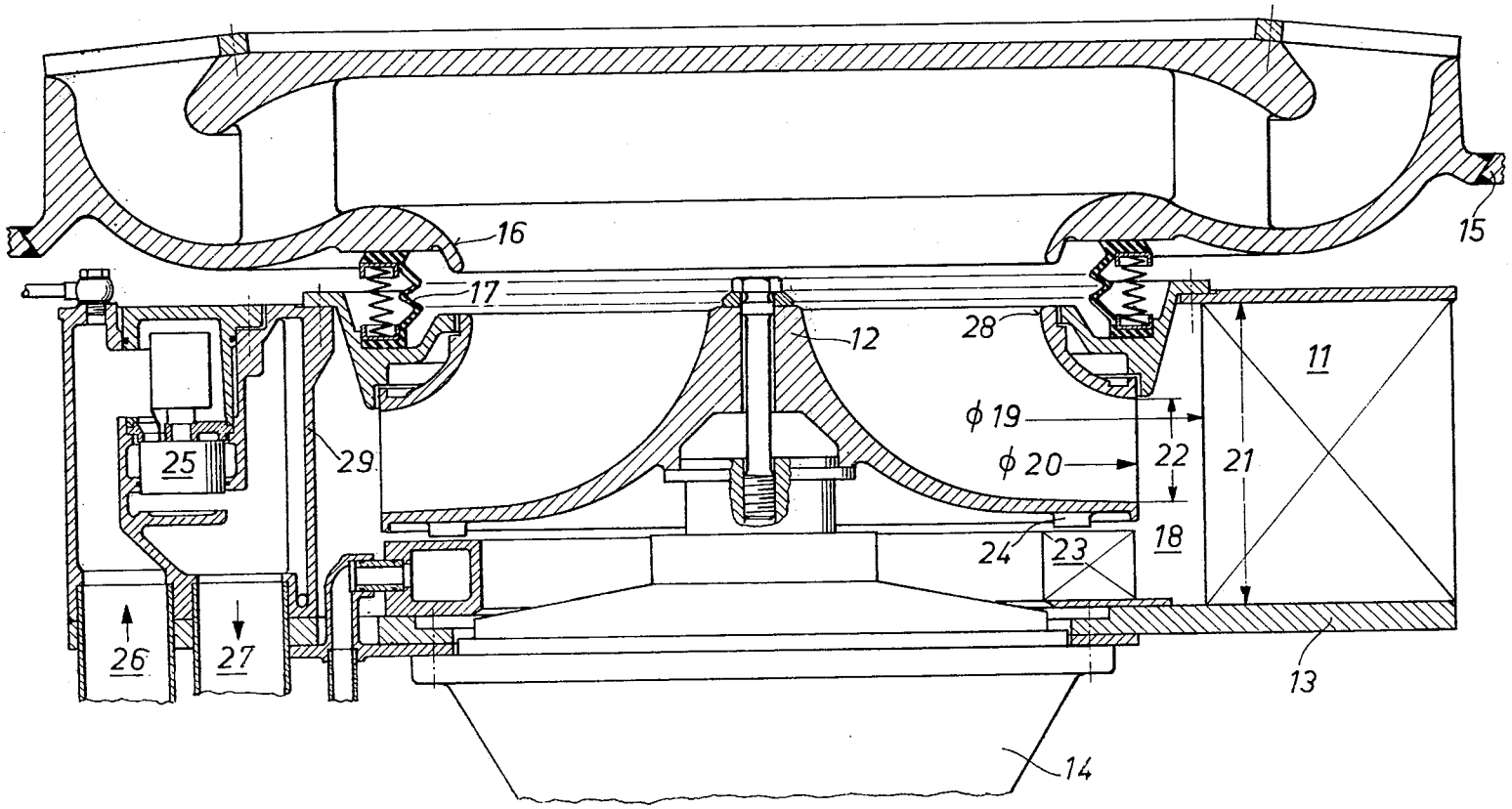
15
11
13
21
22
18
23
14
28
φ19
φ20
24
12
16
17
29
27
25
26

COOLING INSTALLATION

The present invention relates to a cooling installation for liquid-cooled internal combustion engines, for example, for use in armored vehicles, in the form of an annular radiator core or cooler block traversed by the cooling air from the inside toward the outside and having a radial-blower rotor or impeller arranged on the inside of the annular radiator or cooler which sucks in air axially through an opening of the vehicle housing.

By means of this cooling installation the heat due to energy losses of the internal combustion engine are intended to be carried off to the atmospheric air and thereby to be eliminated. The slight space requirement of this type of construction permits the installation into vehicles with slight space availability for the drive system.

Cooling installations of the aforementioned type are known in the art. However, they are still not satisfactory as regards their mechanical rigidity and as regards the necessary space requirement.

It is therefore the aim of the present invention to eliminate the disadvantages existing in the prior art cooling installations and to achieve an improved space utilization.

The underlying problems are solved according to the present invention in that a high mechanical rigidity is achieved by a base place rigidly connected with the vehicle part carrying or supporting the cooling installation, which base is welded together with the annular radiator or cooling block for the cooling water into a self-supporting rigid unit, and in that the outer diameter of the cooling installation is reduced and weight can be saved by a bladeless annular space between the radial-blower rotor and the annular cooling block.

Small external dimensions compared to the known cooling installations with a still good cooling-air distribution in the annular radiator or cooling block are attainable according to the present invention in particular in that the ratio of radiator or cooler inlet diameter to rotor outlet diameter lies within the range of about 1.15 to about 1.2 and the ratio of the radiator or cooler inlet width to the rotor discharge width lies within the range of about 2.7 to about 3.3.

In a cooling installation having a radial-blower rotor or impeller driven mechanically or hydraulically from the vehicle transmission, according to another feature of the present invention, the base plate is directly, rigidly secured at the vehicle transmission and a flexible line section is arranged as seal of the air supply between the air inlet aperture of the vehicle housing and the rotor inlet.

In an internal combustion engine with a fuel cooling system, a particularly favorable space utilization of the cooling installation can be achieved in that according to the present invention, a second annular cooler or radiator for the fuel cooling system is arranged on the base plate concentrically within the first annular cooler or radiator underneath the radial-blower rotor.

According to the present invention, a cooling air stream out of the bladeless annular space through the second annular cooler or radiator is produced by means of auxiliary blades on the backside of the rotor of the radial blower.

A further improvement of the structural space utilization is achieved according to the present invention in that a cooling water thermostat is arranged on the inside of the annular cooler or radiator block within the connecting housing for the cooling water lines.

The advantages attainable with the present invention reside especially in that a cooling installation is provided which with the same cooling output compared to known arrangements possesses a high mechanical strength, a smaller structural volume and a smaller weight, in that as a result of the integration of additional functions, an improved space utilization can be achieved, and in that as regards the thermostat installation, a simplified pipeline layout results.

These and other objects, features and advantages of the present invention will become more apparent from the following description when taken in connection with the accompanying drawing which shows, for purposes of illustration only, one embodiment in accordance with the present invention and wherein:

The single FIGURE is a somewhat schematic cross-sectional view through one embodiment of a cooling installation in accordance with the present invention.

Referring now to the single FIGURE of the drawing, a cooling installation for a liquid-cooled internal combustion engine for use in an armored vehicle consists of an annular radiator or cooling block 11 which is traversed by the cooling air from the inside toward the outside, and of a radial-blower rotor or impeller 12 arranged on the inside of the annular cooler or radiator and axially sucking in the cooling air through an air inlet aperture 16 of the vehicle housing 15, whereby the rotor 12 is driven mechanically or hydraulically from the vehicle transmission 14.

A base plate 13 is welded together with the annular radiator or cooling block 11 into a self-supporting rigid unit. The cooling installation receives thereby such a high mechanical rigidity that the cooling installation can be rigidly secured on the supporting vehicle part. In the illustrated embodiment, the base plate 13 is threadably connected together with the elastically supported vehicle transmission 14.

A flexible line section 17 is arranged as seal of the air supply between the air inlet aperture 16 of the vehicle housing 15 and the rotor inlet 28 and compensates for relative movements between the cooling installation and the vehicle housing 15.

The outer diameter of the cooling installation can be reduced by a bladeless annular space 18 between the radial blower rotor 12 and the annular radiator block 11 and weight can be saved as a result thereof.

The possible reduction of the outer diameter of the cooling installation is limited in that with an increasing reduction of the bladeless annular space, the cooling air distribution in the annular radiator block deteriorates and therewith the cooling output decreases.

Small external dimensions with a good cooling air distribution in the annular radiator block 11 can be achieved especially in that the ratio of the radiator inlet diameter 19 to the rotor outlet diameter 20 lies within the range of about 1.15 to about 1.2 and the ratio of radiator inlet width 21 to rotor discharge width 22 lies within the range of about 2.7 to about 3.3.

With an internal combustion engine having a fuel injection system, a fuel supply pump feeds the injection pump with a quantity of fuel which is greater that the injection quantity required for the operation. The excess fuel flowing back into the tank absorbs so much heat during the passage through the injection pump that it will lead to a heating-up of the entire fuel supply in the course of longer periods of operation. This phenomenon becomes apparent particularly strongly in armored vehicles having an encapsulated drive system and tank by reason of the fact that the dynamic air cooling is prevented by the encapsulation. However, a warmer fuel leads to an output power reduction of the internal combustion engine which is to be avoided by an additional cooling of the fuel.

A particularly favorable space utilization of the cooling installation is attainable in an internal combustion engine with a fuel cooling system in that a second annular cooler or radiator 23 for the fuel cooling system is arranged on the base plate 13 concentrically within the first annular cooler or radiator 11 underneath the radial-blower rotor 12.

Auxiliary blades 24 which are arranged on the backside of the radial-blower rotor 12, produce a cooling air stream for the fuel cooling system out of the annular space 18 through the second annular radiator 23.

A further improvement of the space utilization and a simplification of the pipeline layout is achieved in that a cooling water thermostat 25 is arranged on the inside of the annular cooler or radiator block 11 within the connecting housing 29 for the cooling water lines 26 and 27.

While we have shown and described only one embodiment in accordance with the present invention, it is understood that the same is not limited thereto but is susceptible of numerous changes and modifications as known to those skilled in the art, and we therefore do not wish to be limited to the details shown and described herein but intend to cover all such changes and modifications as are encompassed by the scope of the appended claims.

What is claimed is:

1. A cooling installation for liquid-cooled internal combustion engines, which comprises an annular cooler block means which is traversed by cooling air from the inside toward the outside and which includes an annular cooler means and a radial-blower means with a rotor means, said rotor means being arranged on the inside of the annular cooler means and being operable to axially suck-in cooling air through an inlet opening provided in the vehicle housing, characterized in that a base plate means is rigidly connected with a vehicle part supporting the cooling installation, said base plate means being rigidly connected together with the annular cooler block means into a self-supporting rigid unit, a substantially bladeless annular space being provided between the rotor means and the annular cooler block means, and in that the ratio of cooler inlet diameter to rotor discharge diameter lies within the range of 1.15 to 1.2 and the ratio of cooler inlet width to rotor discharge width lies within the range of 2.7 to about 3.3.

2. A cooling installation for liquid-cooled internal combustion engines, which comprises an annular cooler block means which is traversed by cooling air from the inside toward the outside and which includes an annular cooler means and a radial-blower means with a rotor means, said rotor means being arranged on the inside of the annular cooler means and being driven from a vehicle transmission means to axially suck-in the cooling air through an inlet opening provided in a vehicle housing, characterized in that a base plate means is directly secured at the vehicle transmission means for supporting the cooling installation, said base plate means being rigidly connected together with the annular cooler block means into a self-supporting rigid unit, a substantially bladeless annular space being provided between the rotor means and the annular cooler block means, and in that the ratio of the cooler inlet diameter to rotor discharge diameter lies within the range of about 1.5 to 1.2 and the ratio of cooler inlet width to rotor discharge width lies within the range of about 2.7 to about 3.3, and in that a flexible line section is arranged as a seal of the air supply between the air inlet opening of the vehicle housing and an inlet of the rotor means.

3. A cooling installation according to claim 2, characterized in that the rotor means is mechanically driven from the transmission means.

4. A cooling installation according to claim 2, characterized in that the rotor means is hydrodynamically driven from the transmission means.

5. A cooling installation according to claim 2, for an internal combustion engine with a fuel cooling system, characterized in that a second annular cooler means for the fuel cooling system is arranged on the base plate means substantially concentrically within the first-mentioned annular cooler means and underneath the rotor means.

6. A cooling installation according to claim 5, characterized by auxiliary blade means on the back side of the rotor means of the radial blower means which produce a cooling air stream for the fuel cooling system out of the bladeless annular space through the second annular cooler means.

7. A cooling installation according to claim 6, characterized in that a cooling water thermostat means is arranged inside the first-mentioned annular cooler block means within a connecting housing means for cooling water lines of the internal combustion engine.

8. A cooling installation according to claim 7, characterized in that the base plate means is welded together with the annular cooler block means.

9. A cooling installation for liquid-cooled internal combustion engines, which comprises an annular cooler block means which is traversed by cooling air from the inside toward the outside and which includes an annular cooler means and a radial-blower means with a rotor means, the rotor means is arranged on the inside of the annular cooler means and is driven from a vehicle transmission means to axially suck-in the cooling air through an inlet opening provided in a vehicle housing, characterized in that a base plate means is directly secured at the vehicle transmission means for supporting the cooling installation, said base plate means being rigidly connected together with the annular cooler block means into a self-supporting rigid unit, a substantially bladeless annular space being provided between the rotor means and the annular cooler block means, and in that a flexible line section is arranged as a seal of the air supply between the air inlet opening of the vehicle housing and the rotor inlet line.

10. A cooling installation for liquid-cooled internal combustion engines provided with a fuel cooling system, the cooling installation comprises an annular cooler block means which is traversed by cooling air from the inside toward the outside and which includes an annular cooler means and a radial-blower means with a rotor means, said rotor means being arranged on the inside of the annular cooler means and being operable to axially suck-in the cooling air through an inlet opening provided in a vehicle housing, characterized in that a base plate means is rigidly connected with a vehicle part supporting the cooling installation, said base plate means being rigidly connected together with the annular cooler block means into a self-supporting rigid unit, a substantially bladeless annular space being provided between the rotor means and the annular cooler block means, and a second annular cooler means for the fuel cooling system is arranged on the base plate means substantially concentrically within the first-mentioned annular cooler means and beneath the rotor means.

11. A cooling installation according to claim 10, characterized by auxiliary blade means on the back side of the rotor means of the radial blower means which produce a cooling air stream for the fuel cooling system out of the bladeless annular space through the second annular cooler means.

12. A cooling installation for liquid-cooled internal combustion engines, which comprises an annular cooler block means which is traversed by cooling air from the inside toward the outside and which includes an annular cooler means and a radial-blower means with a rotor means, said rotor means being arranged on the inside of the annular cooler means and being operable to axially suck-in the cooling air through an opening provided in a vehicle housing, characterized by a base plate means rigidly connected with a vehicle part supporting the cooling installation, said base plate means being rigidly connected together with the annular cooler block means into a self-supporting rigid unit, and a substantially bladeless annular space being provided between the rotor means and the annular cooler block means, and by a cooling water thermostat means which is arranged inside the first-mentioned annular cooler block means within a connecting housing means for the cooling water lines.

13. A cooling installation for liquid-cooled internal combustion engines, which comprises an annular cooler block means which is traversed by cooling air from the inside toward the outside and which includes an annular cooler means and a radial-blower means with a rotor means, said rotor means being arranged on the inside of the annular cooler means and being operable to axially suck-in the cooling air through an inlet opening provided in a vehicle housing, characterized by a base plate means rigidly connected with a vehicle part supporting the cooling installation, said base plate means being welded together with the annular cooler block means into a self-supporting rigid unit, and in that a bladeless annular space is provided between the rotor means and the annular cooler block means.

14. A cooling installation for liquid-cooled internal combustion engines, which includes a fuel cooling system, the cooling installation comprises an annular cooler block means which is traversed by cooling air from the inside toward the outside and includes an annular cooler means and a radial-blower means with a rotor means, said rotor means being arranged on the inside of the annular cooler means and being operable to axially suck-in the cooling air through an inlet opening provided in a vehicle housing, characterized by a base plate means rigidly connected with a vehicle part supporting the cooling installation, said base plate means being rigidly connected together with the annular cooler block means into a self-supporting rigid unit, and in that a second annular cooler means for the fuel cooling system is arranged on the base plate means substantially concentrically with the first-mentioned annular cooler means and beneath the rotor means.

15. A cooling installation according to claim 14, characterized in that a flexible line section is arranged as a seal of the air supply between the air inlet opening of the vehicle housing and an inlet of the rotor means.

16. A cooling installation according to claim 14, characterized in that auxiliary blade means are provided on a backside of the rotor means of the radial-blower means for producing a cooling air stream for the fuel cooling system through the second annular cooler means.

17. A cooling installation according to claim 16, characterized in that a flexible line is arranged as a seal of the air supply between the air inlet opening of the vehicle housing and an inlet of the rotor means.

18. A cooling installation according to claim 17, characterized in that a cooling water thermostat means is arranged inside the first-mentioned annular cooler block means within a connecting housing means for cooling water lines of the internal combustion engine.

* * * * *